United States Patent [19]

Brown

[11] 4,107,864

[45] Aug. 22, 1978

[54] SIGN OPENING, CLOSING AND LOCKING DEVICE

[76] Inventor: Donald W. Brown, 218 E. Curling Dr., Boise, Id. 83702

[21] Appl. No.: 770,857

[22] Filed: Feb. 22, 1977

[51] Int. Cl.[2] ..... G09F 7/00

[52] U.S. Cl. ..... 40/601; 40/624

[58] Field of Search ..... 40/125 R, 125 K, 132 R; 248/274, 208; 70/89; 312/131, 132, 139; 49/350, 351, 279, 344, 394; 292/39, 51, 268

[56] References Cited

U.S. PATENT DOCUMENTS

| | | | |
|---|---|---|---|
| 817,907 | 4/1906 | Feist | 74/422 |
| 979,138 | 12/1910 | Ericson | 292/268 |
| 2,164,341 | 7/1939 | Morrison | 49/350 |
| 3,013,475 | 12/1961 | Spangler | 40/132 R |

FOREIGN PATENT DOCUMENTS

| | | | |
|---|---|---|---|
| 740,462 | 1/1933 | France | 49/351 |
| H16753V | 7/1956 | Fed. Rep. of Germany | 49/351 |
| 93,141 | 7/1896 | Fed. Rep. of Germany | 49/279 |

*Primary Examiner*—Louis G. Mancene
*Assistant Examiner*—John J. Wilson
*Attorney, Agent, or Firm*—Paul F. Horton

[57] ABSTRACT

A sign opening, closing and locking device for use on a conventional rectangular, box-like sign having one or more advertising panels hingably attached to the frame. The device comprises gear racks and pinion, a raceway for containing the racks, linkage from the racks to the front panel, and a crank for rotating the pinion. In operation the crank is mated with a shaft to rotate the pinion. Rotation of the crank and the engaged pinion cause linear movement of the racks and the attached linkage resulting in an initial disengagement of the linkage from a stationary lock pin. Further rotation results in an outward movement of the front panel as it is rotated on its hinges. Opposite rotation of the pinion results in closure and locking of the sign.

2 Claims, 4 Drawing Figures

SIGN OPENING, CLOSING AND LOCKING DEVICE

BACKGROUND OF THE INVENTION

1. Field of the Invention

This invention relates in general to advertisement signs, and in particular to sign opening, closing and locking devices.

2. Description of the Prior Art

The problems associated with the servicing of large outdoor signs have long been recognized. Such signs are most often too narrow to permit walkways within the sign for internal maintenance such as cleaning, electrical and mechanical repairing, and the replacement of lights. Because of the physical dimensions and weight of front panels, they are most often divided into a series of smaller panels which may be detached by the serviceman. While allowing proper maintenance, the many paneled sign is extremely cumbersome, and removing the panels is very time consuming as well as dangerous where height is involved. Physically removing the panels is not possible on windy days.

Prior art patents such as Bauers et al, U.S. Pat. No. 2,512,515 and Covington et al, U.S. Pat. No. 2,512,519 illustrate sign opening devices utilizing counterweights and crank and pulleys for lowering the sign face. Such devices allow complete and often unwanted exposure to the entire inner surface of the sign, have bulky opening and closing elements, present problems of proper alignment and replacement of the front panel, and are therefore generally undesirable and of little practical value.

SUMMARY OF THE INVENTION

The present invention comprises a sign opening and closing device useable with hinged front panels, said device having a raceway secured to the bottom frame of a sign; a rack slidably engaging the raceway; a crank operated pinion rotatably engaging the rack, and linkage between the rack and the front panel for producing an inwardly and outwardly motion to the bottom of the front panel as it rotates on its hinges.

It is a general object, therefore, of the present invention to provide a sign opening, closing and locking device operable with a top hinged front panel.

More specifically, it is an object of the present invention to provide a sign opening and closing device having a rack and pinion as the opening and closing mechanism.

Even more specifically it is an object of the present invention to provide a sign opening and closing device having a rack and pinion wherein the rack is attached to the front panel of a sign by levers for rotating the front panel on its hinges.

It is also an object of the present invention to provide a sign opening and closing device which is crank operated and which may be held in a desired open position by means of a spring-loaded friction control means engageable with a pinion.

A further object of the present invention is to provide a sign opening and closing device which is conveniently stored on the interior of the sign, is capable of being opened and closed by crank without physically entering the sign and which is physically easy and convenient to operate.

Additional objects and advantages will become apparent from the following description taken in conjunction with the accompanying drawings.

DETAILED DESCRIPTION OF THE INVENTION

Figure 1:
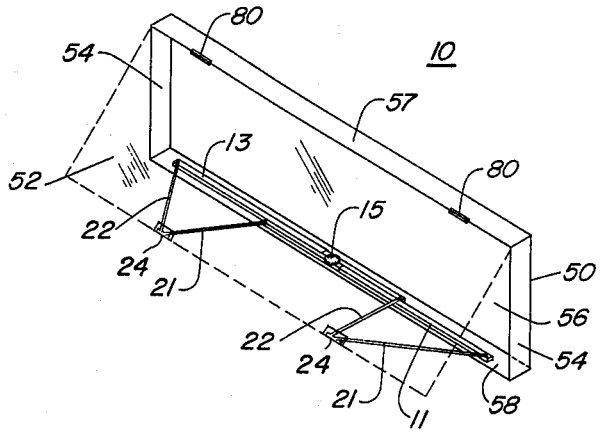
FIG. 1 is an elevated perspective view of a preferred embodiment of the present invention showing a front panel of a sign being held in the open position for servicing.

Referring now to FIG. 1, a typical embodiment of a sign opening and closing device 10, of the present invention as attached to sign 50 for opening and closing front panel 52 is disclosed. Sign 50 includes side panels 54, back panel 56, top panel 57, bottom panel 58 and front panel 52 which includes normal advertising indicia, not shown.

Figure 2:
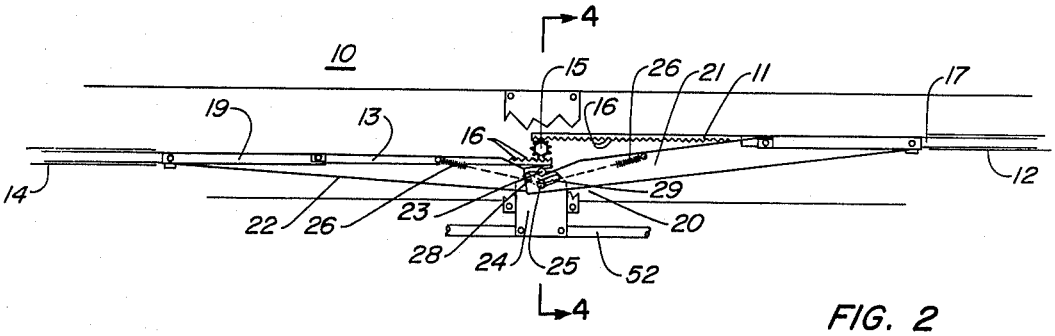
FIG. 2 is a plan view of the sign opening and closing device of the present invention, shown in the closed position.

Referring now to FIG. 2, a more detailed view of the present invention is shown, including the manner of connecting device 10 to front panel 52. Device 10 includes a first raceway 12, a second raceway 14, a first rack 11, a second rack 13, a pinion 15, and linkage shown generally by numeral 20.

First raceway 12 and second raceway 14 are composed of channeling extending lengthwise on the top surface of bottom panel 58, parallel one to the other. Purpose of the raceways is to provide a track to maintain the racks in parallel aligned relationship with one another. It is to be understood that the term "raceway" as used in these specifications and in the appended claims may include only brackets or other similar devices for maintaining the correct positioning of the racks relative to one another and to the pinion. The raceways may be formed and unitary with the material of bottom panel 58 or may be of dissimilar material which has been securely fastened to bottom panel 58 by welding or otherwise.

First rack 11 and second rack 13 are racks of conventional design. In the preferred embodiment the racks contain tubular extensions 17 and 19 for tracking in the raceways and for convenient attachment of levers 21 and 22. Racks 11 and 13 are positioned in reverse relationship with each other so that teeth 16 of the racks mesh properly with the teeth of pinion 15.

Figure 4:
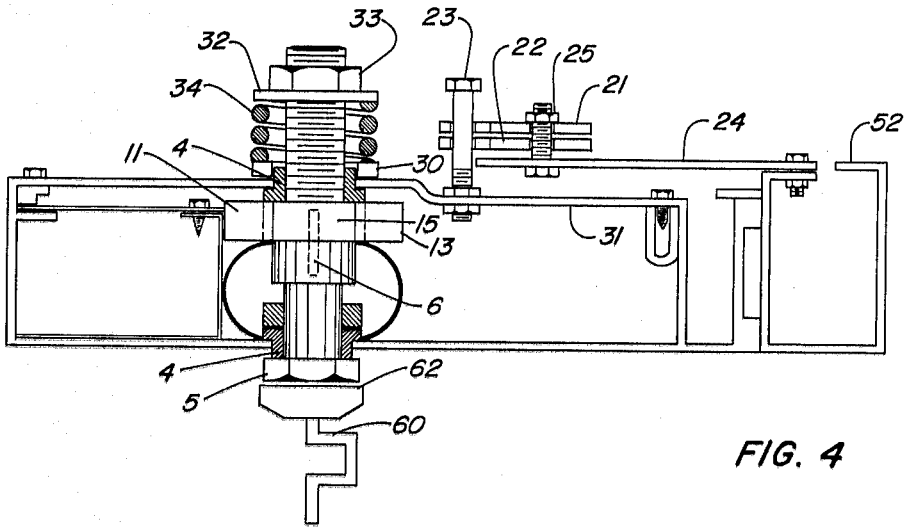
FIG. 4 is a partial sectional view taken along lines 4—4 in FIG. 2.

Referring now to FIG. 4, pinion 15 and its mounting and positioning relative to racks 11 and 13 may be seen to advantage. In the preferred embodiment, pinion 15 is a spur gear which has been attached by key 6 to a ½ inch × 4 inch machine bolt 5. Proper vertical alignment is provided by bushings 4. Ease of rotation of pinion 15 may be regulated by a spring loaded friction control device. The friction control device includes a flat washer 30 fitted over bolt 5 and riding in frictional rotatable contact with pinion support member 31. Proximal to washer 30 and held under tension by washer 32 and nut 33 is coil spring 34. Choice of spring load tension is controlled by the size and weight of front panel 52. In operation, it will be seen that ease of rotation of pinion 15 will be dependent upon the amount of tension placed upon coil spring 34 which controls the pressure on washer 30 which frictionally engages support member 31. Rotation of pinion 15 is brought about by use of crank 60 which mates with the head of bolt 5.

Referring once again to FIG. 2, the details of linkage 20 may be seen. First lever 21 pivotally engages first rack 11 on rack extension 17. At its other end, first lever 21 slidably engages, by means of slot 29, first pin 25 which is securely fastened to the lower portion of front panel 52 by means of plate 24, also seen to good advantage in FIG. 4. Similarly, second lever 22 pivotally engages second rack 13 on rack extension 19, and, at its other end slidably engages first pin 25 by means of slot 28. In the closed position as shown in FIGS. 2 and 4, levers 21 and 22 engage second pin 23 which is securely fastened to bottom panel 56, by means of their respective hooks. Front panel 52 is thereby held in a locked position to prevent accidental opening, with resultant strain on the system, by wind gusts. Springs 26 connected between levers 21 and 22 and first pin 25 serve to maintain a constant pressure between the parts to prevent binding between the slots and the first pin.

Crank 60, the pinion rotation means of the preferred embodiment, is seen to advantage in FIG. 4. Head 62 of crank 60 mates with the head of bolt 5 in a conventional manner. Similar mating may be accomplished by key, wrench, or other conventional means. It is within the contemplation of this invention that either a gear or friction system may be employed between a motor and bolt 5 for power opening and closing of device 10.

Figure 3:
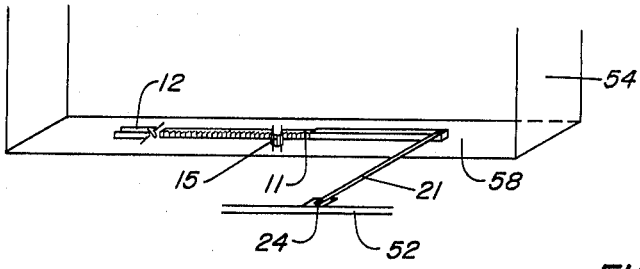
FIG. 3 is a plan view of an alternate embodiment of the present invention.

FIG. 3 shows another preferred embodiment of the present invention. In this embodiment, there is but a single raceway, first raceway 12; a single rack, first rack 11; pinion 15, and a first lever 21. All elements are located and operate in the same manner as described in the preceding embodiment, the difference being fewer parts. It is contemplated that this embodiment will be used on smaller signs where the amount of force required for opening front panel 52 will be substantially less.

In practice, it is contemplated that in using either of the two embodiments described, that a multiplicity of levers with appropriate connections between racks and the front panel may well be employed to give greater stability to the system. Referring to FIG. 1, please note, for example, that a single pinion 15 may be used with a multiplicity of levers 21 and 22 attached at one end to racks 11 and 13 respectively, or extensions thereof, and attached at their other end to front panel 52 by means of a pin secured to plate 24 which is, in turn, secured to the front panel.

In operation, the serviceman wishing to enter the sign to perform necessary service, attaches crank 60 to the head of bolt 5 and rotates the crank to cause rotation of bolt 5 and the keyed pinion 15 in a counter-clockwise direction as viewed from above, as in FIG. 2. Racks 11 and 13 are thereby pulled toward one another in parallel alignment as they interact with pinion 15. It will be seen that as the racks are pulled toward one another, levers 21 and 22 are first pulled toward one another thereby disengaging their respective hooks from second pin 23, and then caused to rotate outwardly at their point of connection with the racks. As pinion 15 is continued to be rotated, an outward force perpendicular to the racks is exerted on first pin 25, forcing the opening of front panel 52 by rotation upon its hinges. The front panel remains in its opened position once crank 60 is removed bacuase of the spring loaded friction control device, earlier described. The serviceman, upon completing his repairs, once again cranks bolt 5 and attached pinion 15, but in an opposite direction causing the front panel to close and lock in position.

Having thus described in detail two preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. In a sign having a substantially rectangular, box-like, frame including two oppositely disposed side panels, oppositely disposed top and bottom panels, a back panel, and a hinged front panel containing advertising indicia, a sign opening, closing, and locking device comprising:

a first and second raceway longitudinally secured to the top surface of the bottom panel, said raceways parallel to one another;

a first and second rack, each slidably engaging one of said raceways;

a pinion rotatably engaging each of said racks for moving said racks in opposite directions to one another upon rotation of said pinion;

a first pin securedly attached to the front panel;

a second pin securedly attached to the bottom panel;

a first and second lever pivotally connecting said first and second rack, respectively to a lower portion of the front panel at a common pivoting juncture, and each lever defining and its end a slot and an adjacent hook, said slots slidably engaging said first pin and said hooks operable to lockingly engage said second pin when the sign opening and closing device is in the closed position; and a pair of springs, each of said springs connecting one of said levers to said first pin for moving the slot relative to said first pin.

2. In a sign having a substantially rectangular, box-like, frame including two oppositely disposed side panels, oppositely disposed top and bottom panels, a back panel, and a hinged front panel containing advertising indicia, a sign opening and closing device comprising:

a first and second raceway longitudinally secured to the bottom panel parallel to one another;

a first and second rack, each slidably engaging one of said raceways;

a pinion, rotatably engaging each of said racks so that said racks move in opposite directions upon rotation of said pinion;

a crank, detachably engaging said pinion for rotating said pinion;

a spring loaded friction control means engaging said pinion for controlling ease of rotation of said pinion;

a first pin securedly attached to the front panel;

a second pin securedly attached to the bottom panel; and a pair of levers, each of which is pivotally attached at one end to a different one of said racks and each of which defines at an end opposite a slot and an adjacent hook, each of said slots slidably engaging said first pin, and each of said hooks lockably engaging said second pin when the sign opening and closing device is in the closed position.

* * * * *